US009358819B1

(12) United States Patent
Ranganathan et al.

(10) Patent No.: US 9,358,819 B1
(45) Date of Patent: Jun. 7, 2016

(54) EGG CARTON PRINTER SYSTEM AND METHOD OF USE

(71) Applicants: Nadeepuram K. Ranganathan, Irvine, CA (US); Barry Brucker, Beverly Hills, CA (US); John P. Clary, Monrovia, CA (US); Hugh Clary, Newport Beach, CA (US); Alexander E. Shafer, Pittsford, NY (US); Robert Ruiz, Monrovia, CA (US)

(72) Inventors: Nadeepuram K. Ranganathan, Irvine, CA (US); Barry Brucker, Beverly Hills, CA (US); John P. Clary, Monrovia, CA (US); Hugh Clary, Newport Beach, CA (US); Alexander E. Shafer, Pittsford, NY (US); Robert Ruiz, Monrovia, CA (US)

( * ) Notice: Subject to any disclaimer, the term of this patent is extended or adjusted under 35 U.S.C. 154(b) by 0 days.

(21) Appl. No.: 14/166,718

(22) Filed: Jan. 28, 2014

Related U.S. Application Data

(60) Provisional application No. 61/757,694, filed on Jan. 28, 2013.

(51) Int. Cl.
*B41J 29/02* (2006.01)

(52) U.S. Cl.
CPC ..... *B41J 29/02* (2013.01)

(58) Field of Classification Search
CPC ..... B41J 3/407; B41J 3/4073; B41J 29/02; B41J 29/13; B41J 25/00; B41J 19/00; B41J 25/34
See application file for complete search history.

(56) References Cited

U.S. PATENT DOCUMENTS

2013/0241978 A1* 9/2013 Clark ..... B41F 19/007 347/2

* cited by examiner

*Primary Examiner* — Alessandro Amari
*Assistant Examiner* — Jeremy Delozier
(74) *Attorney, Agent, or Firm* — One3 IP Management, P.C.; Jerome V. Sartain; Dean G. Stathakis

(57) ABSTRACT

A printer system comprising a printer having a printhead operatively installed therein, the printer including a housing having opposing thumb screws extending outwardly therefrom, and a mount comprising a printer bracket having opposite printer bracket side members each terminating in a distally extending side member leg configured for attachment to the rail, the printer bracket side members each further having a mounting slot formed therein with a vertical slot portion and at least one horizontal slot portion and a rail bracket having a rail bracket top member with opposite substantially downwardly extending rail bracket side members terminating in outwardly extending side member legs configured for attachment to the rail, whereby the printer is received within the mount and selectively positioned therein as by engaging the thumb screws within the mounting slots so as to position the printhead as desired beneath the rail bracket top member.

14 Claims, 8 Drawing Sheets

EGG CARTON PRINTER SYSTEM AND METHOD OF USE

RELATED APPLICATIONS

This application claims priority and is entitled to the filing date of U.S. Provisional application Ser. No. 61/757,694, filed on Jan. 28, 2013, and entitled "Egg Carton Printer System and Method of Use." The contents of the aforementioned application are incorporated by reference herein.

INCORPORATION BY REFERENCE

Applicant(s) hereby incorporate herein by reference any and all patents and published patent applications cited or referred to in this application.

BACKGROUND OF THE INVENTION

1. Field of the Invention

Aspects of this invention relate generally to printers, and more particularly to printers configured for printing coding or tracking information on an egg carton.

2. Description of Related Art

By way of background, printing of coding or tracking information on egg cartons is known, as such is required for traceability and per FDA requirements and the like. However, current egg carton printing techniques are deficient in a number of respects. First, and currently the most common arrangement, is a mechanical stamper, or reciprocating ink printer or pad printer. Such a printer requires that the print substrate (in this case the egg carton) be stationary and so is typically installed adjacent the "egg drop" area of the egg carton filling line, where the carton would be mechanically indexed and held in place by a stabilizing arm, thereby ensuring that each carton is always in the same position for the egg drop, and thus for printing as well at that same station. But such stampers or pad printers have a number of shortcomings. Due to the fact that the mechanical printers use metallic type sets, variable printing (i.e., real-time printing with date, time, etc.), which is required for better traceability and recall, is not possible. In other words, mechanical printing offers only fixed or limited message printing which doesn't serve the purpose of date coding for improved traceability and to limit any expensive recalls to a specific affected batch, plant, production line, window of production time, etc. Also, mechanical stampers require relatively constant and expensive manual intervention in changing the type sets, inking the pad, etc. Thus, while mechanical stampers offer relatively consistent print quality, they are not readily adapted to changing lot/batch coding information. And when it is considered that the average egg farm has 60 to 120 such printers, it will be appreciated that manually changing the pad printer type set information to update the date or other batch information would be quite cumbersome and so is simply not done that often, providing less effective traceability (e.g. to a whole week or span of days versus true, robust, real-time traceability).

As such, thermal ink jet, continuous ink jet, and drop-on-demand print technologies have made their way into the egg carton printing context as an alternative to mechanical stampers. However, these printers have shortcomings as well. With such printers, the distance from the printhead to the substrate is very critical to ensure a good quality print. The distance has to be substantially constant in order for the ink drops ejected from the printer to be placed in the right locations on a moving object. As such, two parameters that determine accuracy and clarity in ink jet printing are the speed and the distance. If the product or print substrate is moving at a constant speed and at a constant distance (specified) from the printhead, one could potentially have a good print, assuming the right ink for the substrate as well. But specific to egg cartons, trying to print on a moving carton is a very big challenge. There are basically two opportunities or options to print a moving carton in the typical egg carton fill line and both present significant difficulties and significantly compromise reliability and functionality. Again, all such ink jet printing technologies rely on relative movement between the printhead and the print substrate. So, in the egg carton printing context, such ink jet printers have been employed either before the egg drop once the empty cartons are de-nested and put on a conveyer delivering them to the egg drop or after the egg drop as part of the take-away conveyor. Once again, though, each such approach presents challenges and deficiencies in practice. First, regarding the de-nested, empty cartons on the delivery conveyor ahead of the egg drop, it will be appreciated that the cartons, whether made of cardboard, pulp, foam, or PET, are very light and so would normally tend to be skewed when they are de-nested, as the cartons are really not positively located or indexed until they enter the egg drop section. As such, the light weight cartons do not allow alignment or presentation of the empty cartons at a uniform distance from the printhead, creating problems for print quality. The other option employed to this point is to place an ink jet printer along the take-away conveyor. There, the cartons are at least weighed down a bit by the eggs now in them and coming out of the egg drop are more consistently aligned on the conveyor. But in addition to there still remaining concerns even along the take-away conveyor of the cartons either being askew or otherwise not at a consistent distance from the printhead as they pass by, there is also the possible issue of a carton not being closed properly and the eggs themselves, rather than the carton, being printed on, at least in part. With either approach—printing before or after the egg drop—there are also issues that arise since the speed of the carton likely is variable, such that it may become necessary to have an expensive encoder system to detect the speed of the carton and/or conveyor and relate it to the printer to ensure print placement relative to the carton. Also, if barcode printing (2D) becomes necessary or is desired, printing on the de-nester or takeaway conveyor without accurate alignment of the carton and constant speed (or an encoder system to monitor and account for speed variance) would not be possible.

Finally, in view of the foregoing challenges and shortcomings of each printing option, it would seem that a variable printing mechanical printer would be ideal, but such a system is effectively cost prohibitive and significantly limits the printing speed.

As such, it will be appreciated that all known egg carton printing approaches employed to date have one or more shortcomings. Accordingly, aspects of the present invention fulfill these needs and provide further related advantages as described in the following disclosure.

SUMMARY OF THE INVENTION

Aspects of the present invention teach certain benefits in construction and use which give rise to the exemplary advantages described below.

The present invention solves the problems described above by providing a relatively cost-effective thermal ink jet printer or other such printer with a scanning (movable) printhead configured for installation adjacent the egg drop station of an egg carton fill line in the place of the former mechanical stamper so as to enable real-time coding information to be printed on each carton as it is filled without significant retrofit of the line, as discussed in detail below. It is to be appreciated and expressly understood that while a thermal ink jet ("TIJ") printer is employed and described in connection with the exemplary embodiment, the present invention is not so limited; rather, any other such printing technology now known or later developed may be employed, including but not limited to continuous ink jet, drop-on-demand, and piezoelectric printheads.

It will be appreciated by those skilled in the art that the exact configuration of the egg carton printer apparatus may take a number of forms to suit particular applications without departing from the spirit and scope of the present invention. Accordingly, it will be further appreciated that the configuration of the apparatus shown and described is exemplary and that the invention is not so limited.

A primary objective inherent in the above described system and method of use is to provide advantages not taught by the prior art.

Another objective is to provide such a system and method that comprises a printer with movable printhead and a mount for mounting the printer on a rail, in at least one embodiment.

A further objective is to provide such a system and method having at least two printers each having an associated controller, each such printer being configured for installation on an egg carton fill line in the place of a former mechanical printer, and a computing device selectively communicating with the at least two printers via the associated controller over a communication network.

A still further objective is to provide such a system and method entailing configuring a printer with a movable substantially distally extending printhead and with a controller, mounting each printer in a mount on an egg carton fill line so as to position the printhead adjacent to a conveyer of the fill line, networking two or more of the printers through connecting the controllers to a computing device over a communication network, sending printing instructions to each printer, and obtaining data from each printer.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

The above described drawing figures illustrate aspects of the invention in at least one of its exemplary embodiments, which are further defined in detail in the following description. Features, elements, and aspects of the invention that are referenced by the same numerals in different figures represent the same, equivalent, or similar features, elements, or aspects, in accordance with one or more embodiments.

DETAILED DESCRIPTION OF THE INVENTION

The above described drawing figures illustrate aspects of the invention in at least one of its exemplary embodiments, which are further defined in detail in the following description.

Figure 1:
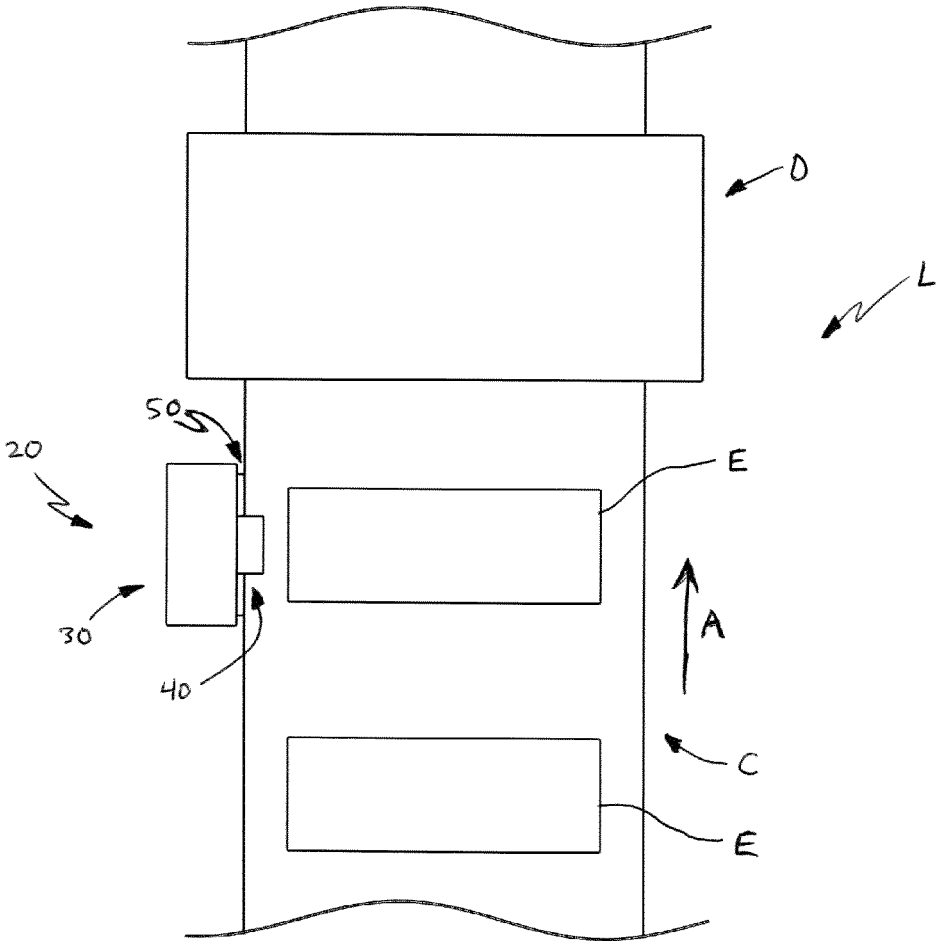
FIG. 1 is a schematic view of an exemplary egg carton printer system, in accordance with at least one embodiment.

Turning now to FIG. 1, there is shown a schematic view of an exemplary embodiment of an egg carton printer system 20 according to aspects of the present invention. As a threshold matter, it will be appreciated by those skilled in the art that while the printer system and method is shown and described in the egg carton context, the invention is not so limited, but may instead be applied to a variety of other packaging contexts without departing from its spirit and scope. It is also noted more particularly that while components of a conventional egg carton factory fill line are shown and described, these are simply for context or the environment of the invention and form no part thereof; rather, the present invention is adapted to interface with such components, as will be appreciated from the below more detailed discussion. The system 20 comprises, in one embodiment, at least one printer 30 having a printhead 40 and a mount 50 for attaching the printer 30 to the conveyor C of the fill line L. As illustrated, the fill line L further entails an egg drop D that is down the line from an indexed location at which the printer 30 is positioned, the egg cartons E moving on the conveyer C in the direction of arrow A but stopping or indexing at certain locations to account for or enable positioning of an egg carton E within or beneath the egg drop D in a manner known in the art. FIG. 1 being a schematic, it is not to be taken to scale in any respect.

Figure 2:
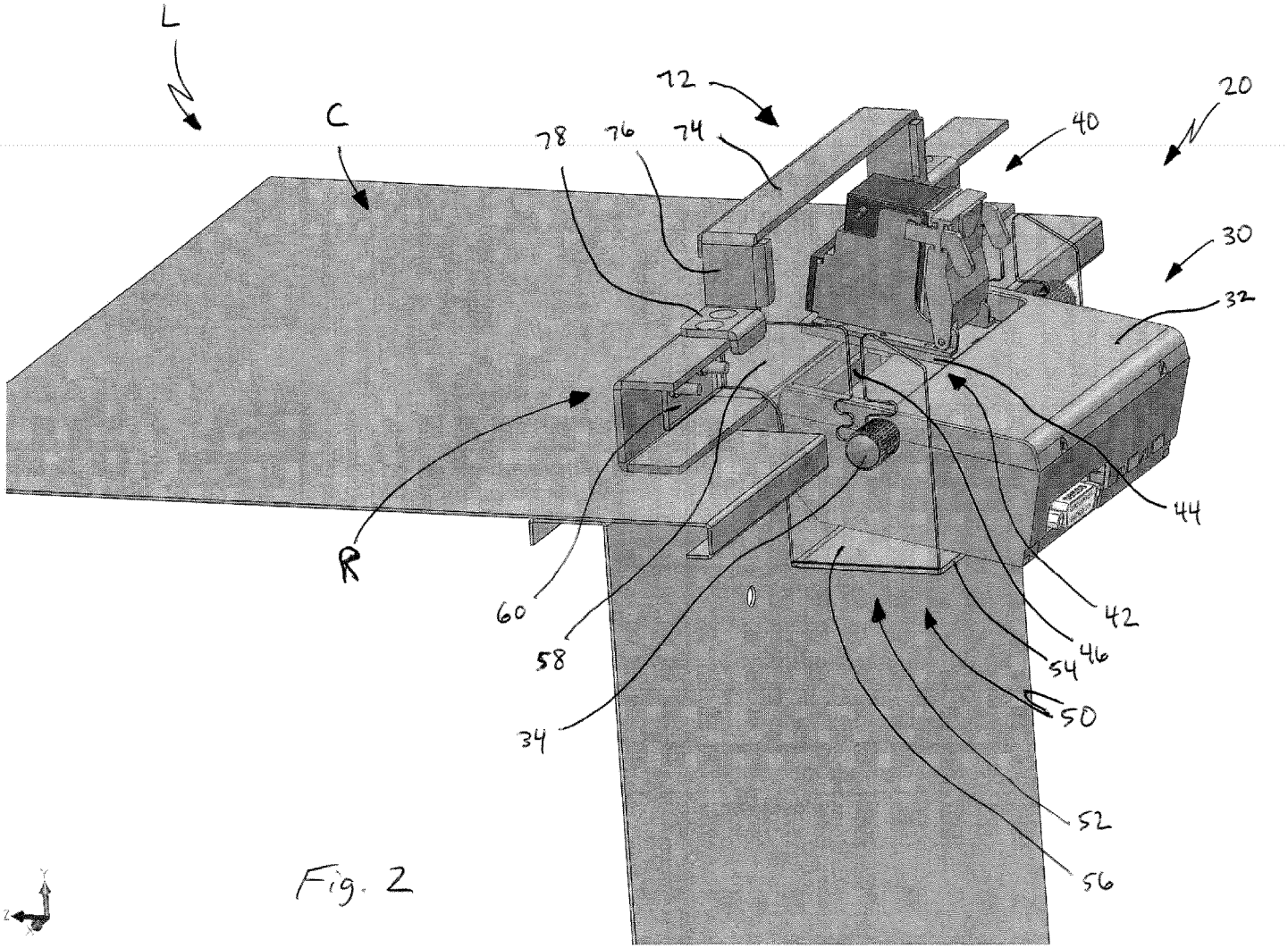
FIG. 2 is a partial side perspective view thereof with the printer in a first operational position, in accordance with at least one embodiment.
Figure 3:
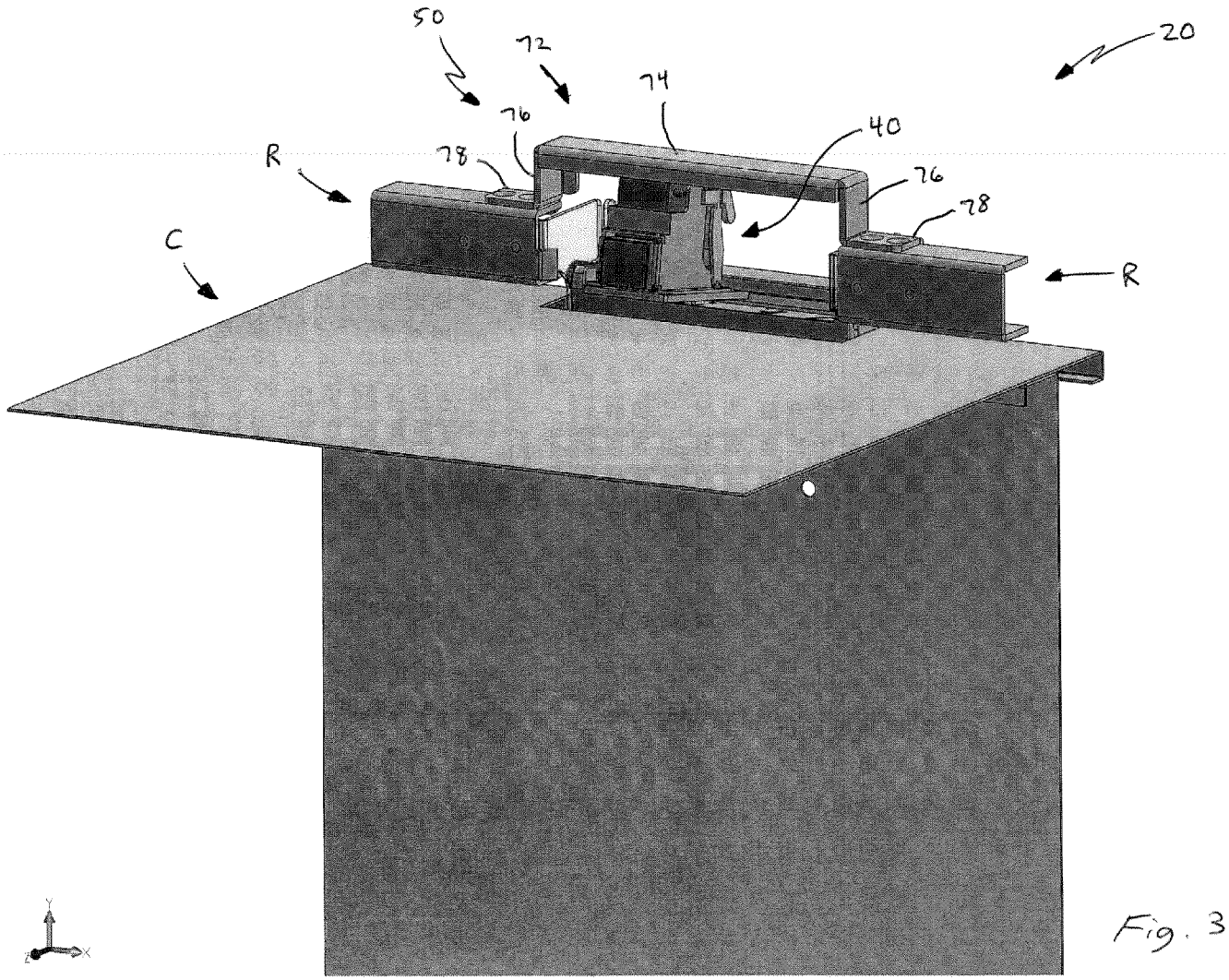
FIG. 3 is a partial front perspective view thereof, in accordance with at least one embodiment.
Figure 4A:
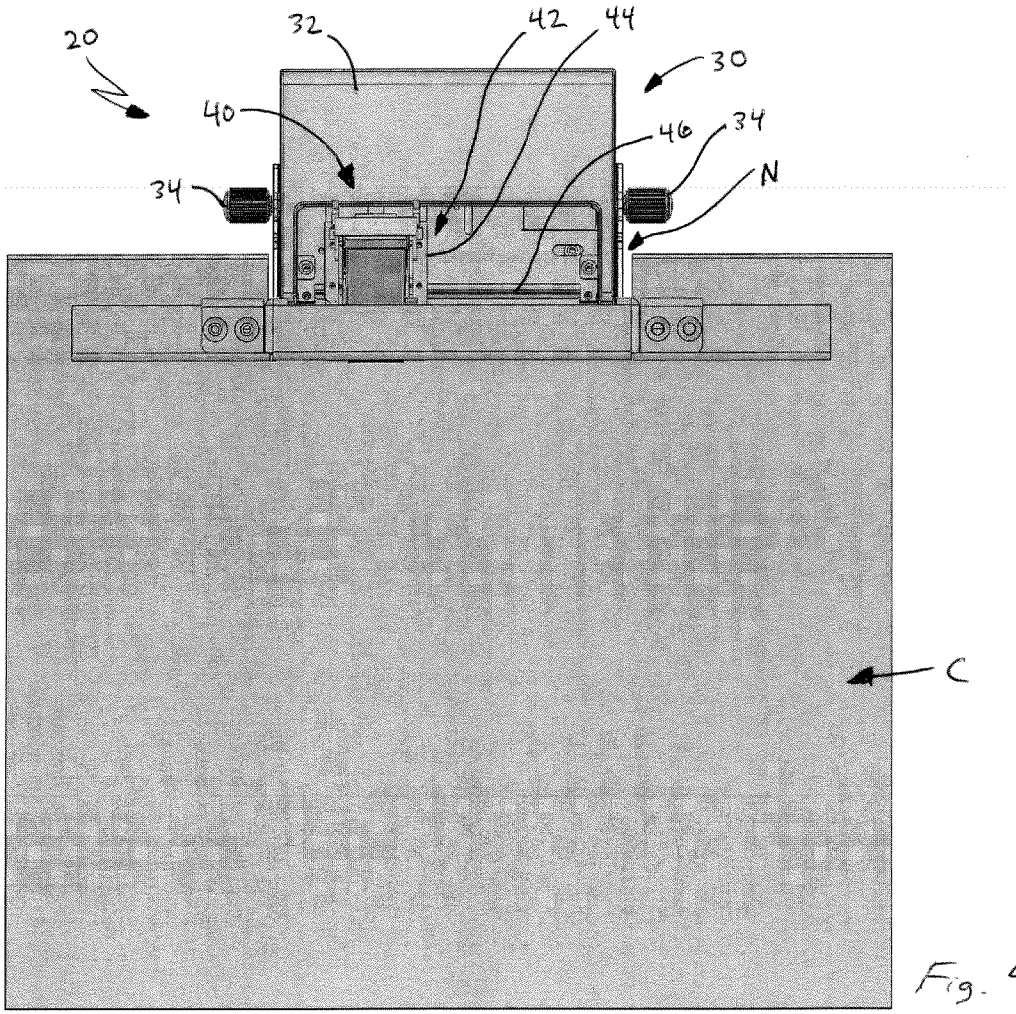
FIG. 4A is a partial top view thereof with the print head in a first operational position, in accordance with at least one embodiment.
Figure 4B:
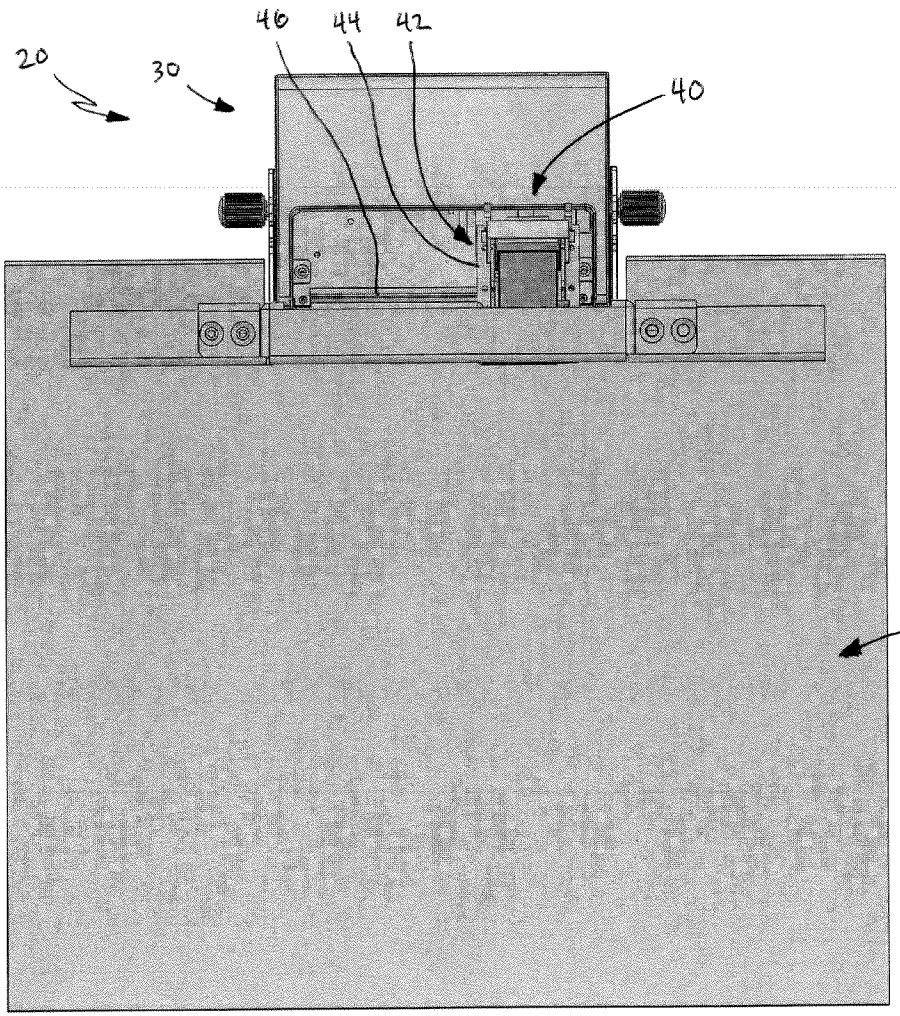
FIG. 4B is a partial top view thereof with the print head in a second operational position, in accordance with at least one embodiment.

Referring now to the partial perspective view of FIG. 2, the egg carton printer system 20 and associated method of use according to aspects of the present invention once again essentially entails a thermal ink jet printer or other such printer 30 with a scanning (movable) printhead 40 within or adjacent the housing 32 that is configured for installation adjacent the egg drop station D (FIG. 1) of an egg carton fill line L in the place of the former mechanical stamper (not shown) so as to enable real-time, user-configurable coding information to be printed on each carton E (FIG. 1) as or prior to it being filled. As such, the egg carton printer 30 is specifically sized and shaped to fit into the same slot or physical space where a mechanical printer is currently or typically located, with only a slight modification to the bed of the packaging machine required to accommodate the new TIJ egg carton printer 30. That is, as shown best in the exploded perspective view of FIG. 5, in a representative factory fill line L, and conveyor C specifically, the bed of the conveyor C is typically formed along an edge with a cut-out or notch N configured for accommodating the conventional stamper or pad printer (not shown). More about the physical mounting of the new printer 30 will be said below in connection with some of the other figures. The egg carton printer 30 has a mechanically adapted printhead 40 with a carriage system 42 comprised of at least a base 44 and a track 46 so as to enable lateral movement of the printhead 40 within the printer 30 along and substantially parallel to the conveyor C and thereby print on or along the temporarily stationary egg cartons E (FIG. 1), such lateral movement of the printhead 40 being best seen in the overhead views of FIGS. 4A and 4B showing movement of the printhead 40 from a first operational position to a second. The printhead 40 preferably extends distally away from the printer 30, and the printer housing 32 specifically. As best seen in FIG. 3, the printhead 40 being positioned vertically substantially above and adjacent to the conveyor C helps ensure that the printhead 40 is below the lip or mid-plane of the carton E (FIG. 1), or positioned substantially adjacent to the bottom half of the carton, for consistent printing on the carton even if it is open. Again, with the egg carton E mechanically indexed and held in position by a stabilizing bar (not shown) as part of the conventional egg drop station D (FIG. 1) architecture, the printhead 40 is at a substantially consistent distance from each egg carton E (FIG. 1), and no speed encoder is needed since the egg carton is not moving momentarily while at or adjacent the egg drop station, resulting in reliable and relatively inexpensive printing. In the exemplary embodiment, the movable or scanning printhead 40 also is capable of printing in both directions, or forward or backward, thus enabling relatively high-speed printing and faster cycle times. An integrated photocell or other such sensor or transducer (not shown) may be provided with the printer 30 for the purpose of positively verifying the presence/location of the egg carton E (FIG. 1) before a printing sequence commences.

Figure 5:
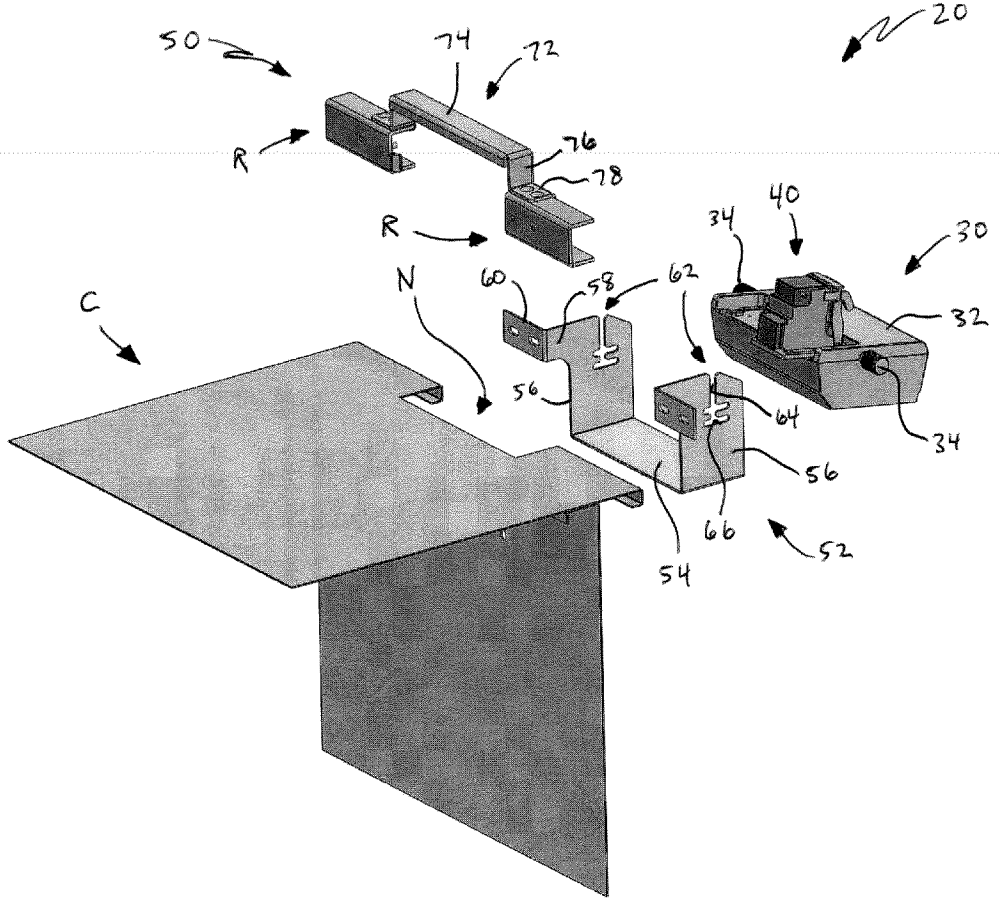
FIG. 5 is a reduced scale partial exploded perspective view thereof, in accordance with at least one embodiment.
Figure 6:
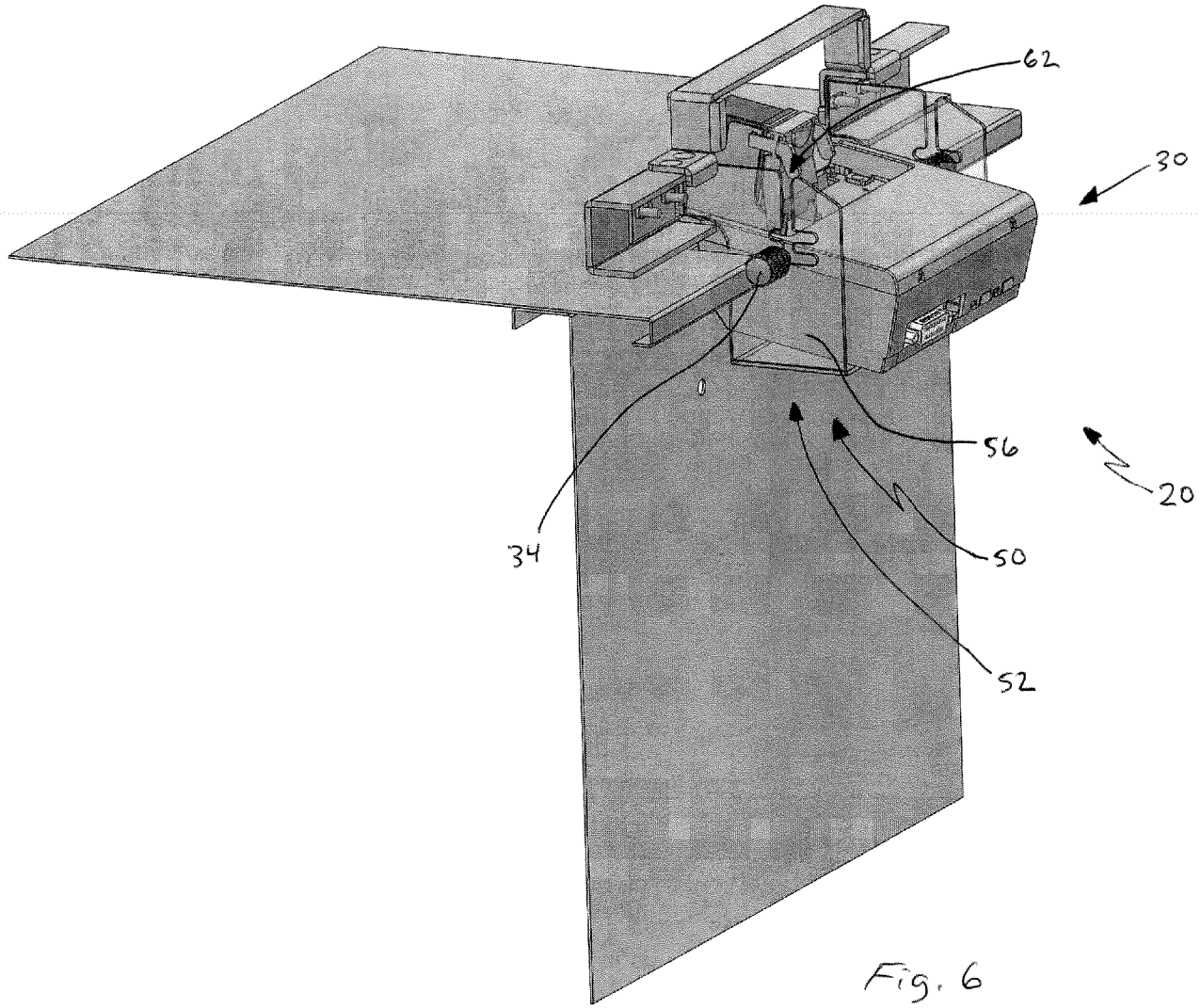
FIG. 6 is a partial side perspective view thereof with the printer in a second operational position, in accordance with at least one embodiment.

With continued reference to particularly the perspective views of FIGS. 2 and 3 and the exploded view of FIG. 5, in order to have the printhead 40 substantially parallel to the angled lower surface of the typical egg carton E (FIG. 1), or the front or back wall of the bottom half of the carton, the printer 30 is installed adjacent to the conveyor C near the egg drop station D a bit canted, or at a slight horizontal angle, so as to account once again for the angled surface of the egg carton that is to be printed on. It will be appreciated that such angle of the printhead 40 can be achieved by virtue of its incorporation into the printer 30—that is, based on the design of the housing 32 and/or of the base 44 and track 46 of the carriage system 42 for the printhead 40—or by virtue of the installation of the printer 30 within the mount 50 or by virtue of some combination thereof. As shown, the mount 50 is formed comprising a printer bracket 52 and a rail bracket 72, both of which are configured to be attached or tied into existing rails R running along the conveyor C of the fill line L (FIG. 1). The printer bracket 52 comprises in the exemplary embodiment a substantially horizontal printer bracket bottom member 54 having extending from opposite ends thereof offset substantially vertical printer bracket side members 56. Each such printer bracket side member 56 is formed having a distally extending side member leg 58 terminating in a side member foot 60 that is bent relative to the respective leg 58 and is configured to be attached to the conveyor rail R via any fastening means now known or later developed, including but not limited to screws, rivets, or welding. In the exemplary embodiment the rail R is formed with a "C" cross-section and positioned so as to open away from the conveyor C, and the feet 60 of the printer bracket side members 56 are formed so as to be substantially received within the C-shaped rail R, rendering the feet 60 substantially flush with the inside surface of the vertical portion of the rail R. Furthermore, formed in each printer bracket side member 56 proximal of the side member legs 58 is a mounting slot 62 having a substantially vertical slot portion 64 intersecting the upper edge of the side member 56 and one or more substantially horizontal slot portions 66, all such slot portions communicating therebetween for the passage therethrough and positioning therein of a pin, dowel, bolt, or the like so as to effectively install the printer within the mount 50, more about which is said below. Regarding the rail bracket 72, as shown, in the exemplary embodiment it is formed having a substantially horizontal rail bracket top member 74 with opposite substantially downwardly extending rail bracket side members 76 terminating in outwardly extending side member legs 78. The side member legs 78 are formed so as to substantially seat flush on the top horizontal portion of the C-shaped rails R and may be secured or attached thereto using any fastening means now known or later developed, including but not limited to screws, rivets, or welding. The rail bracket 72, and the top member 74 specifically, is configured to span the opening between the rails R in the region of the notch N formed in the conveyor for the accommodation of the printer 30. Moreover, the rail bracket side members 76 are configured to vertically position the rail bracket top member 74 clear of the printhead 40 while the resulting rail bracket 72 provides integrity to both the rail R and the printer mount 50 and thus the secure positioning of the printer 30. The rail R may be positioned on and secured to the conveyor C in any conventional method now known or later developed. As installed for use, then, with the printer bracket 52 and the rail bracket 72 of the mount 50 installed on the rails R as shown and described above, and the rail R itself in position on the conveyor C in the manner required, the printer 30 is then installed on the mount 50 so that the printhead 40 is positioned beneath the rail bracket 72 and directed toward the conveyor C. More particularly, in the exemplary embodiment, the printer 30 is configured with opposite outwardly extending thumb screws 34 threadably received within the housing 32 and sized and located so as to fit within the mounting slots 62 as the printer 30 is received within the printer bracket 52. As such, the printer may be selectively adjusted in terms of its horizontal and vertical spatial location and orientation by selectively positioning the thumb screws within the mounting slots 62, and the vertical and horizontal slot portions 64 and 66, specifically, and tightening to secure the printer 30 in the desired position. As such, it will be appreciated that both macro and micro adjustment of the positioning of the printer 30 is possible with the mount 50 according to aspects of the present invention. For example, with reference to the side perspective view of FIG. 6, there is shown the printer 30 in a different position within the printer bracket 52 and the mount 50 as compared with that of FIG. 2. Those skilled in the art will appreciate that a variety of other mounting means now known or later developed may be employed in the present invention without departing from its spirit and scope. Fundamentally, again, with an objective being to articulate and position the printer 30 as desired so as to print on a package such as an egg carton E (FIG. 1) that may have an angled surface, or at least a surface to be printed on that is a known and relatively fixed distance away from the rail R for example, it will be appreciated that such selections as the horizontal or lateral distance of the printer 30 from the conveyor C or rail R or the angle of the printer 30 relative to horizontal can all be adjusted and set via the mount 50, so as to arrive at, for example, a printer 30 installation that is canted as above-described and best seen in FIGS. 2 and 3.

Figure 7:
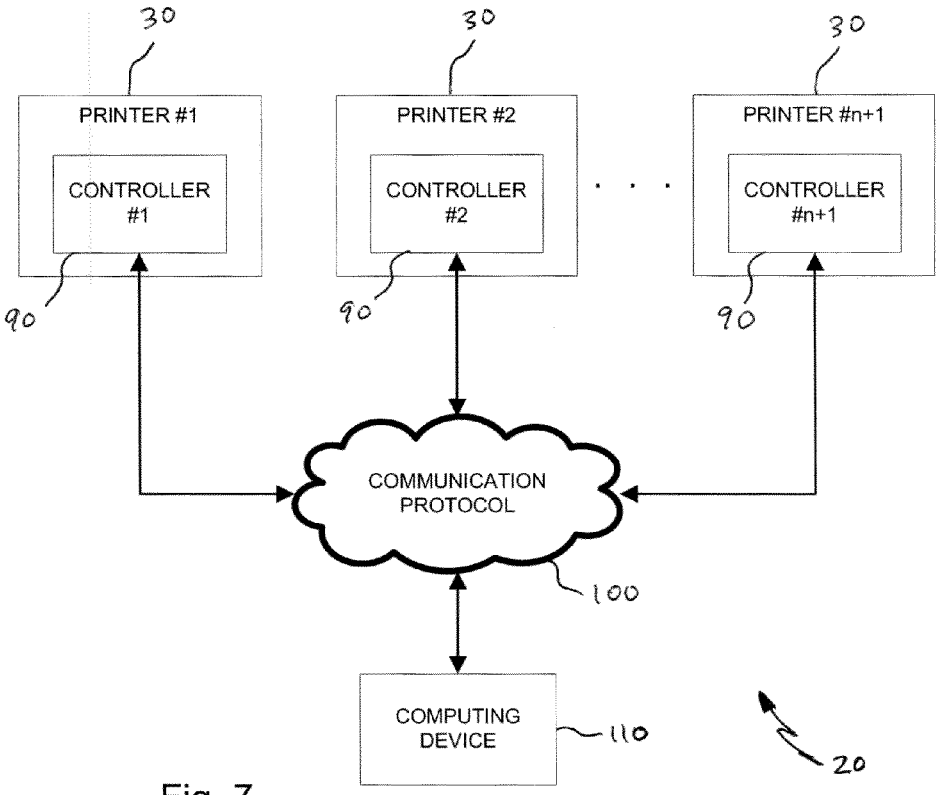
FIG. 7 is a block diagram thereof, in accordance with at least one embodiment.

With reference now to FIG. 7, it is further contemplated that within the egg carton printer system 20 each egg carton printer 30 will be integrated into the egg packaging line L (FIG. 1) and linked to an individual controller 90 that in addition to providing outputs for remote control and networkability offers the operator message selection capability and printer status on every line and for every printer. As such, printer status such as print count, ink levels, etc. is all electronically monitored both locally and remotely through a wired or wireless network, generally denoted the communication protocol 100, and each printer 30 may be enabled to send emails and/or text messages regarding such status indicators and any faults. Again, the printer 30 has both wired and wireless network capability, including Blue Tooth, and so can be accessed from any Smartphone as well as of course from a conventional computer connected to the network, or any other such computing device 110. Any such device 110 would be configured with or be able to access an appropriate user interface (not shown) for facilitating such interaction with the printer(s) 30, even remotely. In such a case, proprietary web-based software allows for easy networkability and also monitoring of individual printers 30 over the Internet 100. In the end, each printer 30 is fully programmable and capable of printing variable information including barcodes, and it will thus be appreciated that the content of any such coding or tracking information can be changed readily, whether on-site or remotely, thus enabling more specific tracking or lot information to be printed on the egg cartons E (FIG. 1), including time and not just date. By having multiple printers 30 networked, multiple labels can be created from a single template and downloaded over the network 100, such labels being user configurable as to type (e.g., "Date Offset" or "Best Used By") and substance. Date and time information can be manually configured/entered or be automatically populated based on an algorithm that is part of the embedded code of the printer 30 or provided from a computer 110 on the network 100, either such device having access to actual time through an appropriate network connection and/or an on-board clock circuit (not shown). In this way, again, "real time" lot/batch production information as well as farm/line and other tracking information can be printed on each egg carton E (FIG. 1) as it is filled, providing much more detailed traceability in the event of a recall event or other such occurrence regarding which corrective action is needed. Once more, it will be appreciated by those skilled in the art that aspects of the present invention are suitable for a variety of other factory or packaging contexts beyond the exemplary egg farm context, such that the present invention is not so limited. More generally, it will also be appreciated regarding the network or communication protocol 100 that the means for allowing communication between each of the printers 30 and any computing device 110 may be any wired- or wireless-based communication protocol (or combination of protocols) now known or later developed. As such, the present invention should not be read as being limited to any one particular type of communication protocol, even though certain exemplary protocols may have been mentioned herein for illustrative purposes. It should also be noted that the term "computing device" is intended to include any type of computing device now known or later developed, such as desktop computers, mobile phones, smartphones, laptop computers, tablet computers, personal data assistants, gaming devices, etc.

Those skilled in the art will appreciate that the type of ink used in the thermal ink jet printer 30 is also important for the success of the complete solution or printer system 20, as often such selection is based on the type of substrate to be printed on. Since the typical egg cartons E (FIG. 1) are made of cardboard, pulp, foam, and PET, a very reliable ink solution that works in the thermal ink jet context without decreasing the life of the cartridge prematurely is important. And since the cost per print is also an important factor, yield and reliability of the ink in the printer is a consideration as well. Therefore, an aqueous or water-based ink will typically be employed to print on cardboard or pulp and a solvent-based ink to print on foam or PET, though it will be appreciated that other inks or ink-substrate combinations now known or later developed may be employed. Proprietary solvent-based ink and water-based ink beyond the scope of the present application have been custom designed to work in the cartridge of an egg carton printer according to aspects of the present invention.

It will be further appreciated once more that while the printer 30 is described in the context of egg carton printing, and as being installed adjacent the egg drop station D of the typical carton filling line L, the invention is not so limited. Specifically, such a printer 30 also has significant application in other packaging contexts such as "form, fill, and seal" equipment, which, like the egg carton context, presents the same challenges of incorporating the printer into a part of the machine wherein the package to be printed on is stationary, in which case the printhead is to be movable, or the package is moving, in which case registration (having the package a consistent distance from the printhead) is key. But aspects of the present printer 30 with its form factor and traversing capabilities with a wide range of inks that may be utilized can present a solution in niche markets wherein digital printing on stationary products is necessary or desirable. Again, the networkability of the printers 30 offers to the discerning user the ability to monitor the messages and the printer status per line while offering the ability to securely create and download messages to individual printers remotely. Once again, when it is considered that there are 60 to 120 printers at the typical egg farm, for example, the ability to configure and monitor the status of all such printers from a single computer or even a Smartphone or other such device has clear advantages. Moreover, the printer design and the software architecture enables charging on a per print basis, thus ensuring transparency and also providing a pre-determined fixed cost per print for the customer or end user.

To summarize, regarding the exemplary embodiments of the present invention as shown and described herein, it will be appreciated that an ink jet printer system is disclosed as being configured for printing on an egg carton or other packaging when it is stationary by equipping the printer with a movable printhead. In this way, the challenges presented by employing an ink jet printer relative to a moving carton or package, such as before or after the egg drop in the egg carton context, are avoided, as are the numerous downsides of traditional mechanical stampers such as type-setting by hand, inconsistent print quality from type pressure, frequent ink pad filling, and related downtime and mess, by relatively easily replacing such stampers with a thermal ink jet printer or other such printer according to aspects of the present invention. Because the principles of the invention may be practiced in a number of configurations beyond those shown and described, it is to be understood that the invention is not in any way limited by the exemplary embodiments, but is generally directed to a relatively cost-effective thermal ink jet printer or other such printer with a scanning (movable) printhead configured for installation adjacent the egg drop station of an egg carton fill line in the place of the former mechanical stamper so as to enable real-time coding information to be printed on each carton as it is filled without significant retrofit of the line, and so is able to take numerous forms to do so without departing from the spirit and scope of the invention. It will also be appreciated by those skilled in the art that the present invention is not limited to the particular geometries and materials of construction disclosed, but may instead entail other functionally comparable structures or materials, now known or later developed, without departing from the spirit and scope of the invention. Furthermore, the various features of each of the above-described embodiments may be combined in any logical manner and are intended to be included within the scope of the present invention.

It should be understood that the logic code, programs, modules, processes, methods, and the order in which the respective elements of each method are performed are purely exemplary. Depending on the implementation, they may be performed in any order or in parallel, unless indicated otherwise in the present disclosure. Further, the logic code is not related, or limited to any particular programming language, and may comprise one or more modules that execute on one or more processors in a distributed, non-distributed, or multiprocessing environment.

The method as described above may be used in the fabrication of integrated circuit chips. The resulting integrated circuit chips can be distributed by the fabricator in raw wafer form (that is, as a single wafer that has multiple unpackaged chips), as a bare die, or in a packaged form. In the latter case, the chip is mounted in a single chip package (such as a plastic carrier, with leads that are affixed to a motherboard or other higher level carrier) or in a multi-chip package (such as a ceramic carrier that has either or both surface interconnections or buried interconnections). In any case, the chip is then integrated with other chips, discrete circuit elements, and/or other signal processing devices as part of either (a) an intermediate product, such as a motherboard, or (b) an end product. The end product can be any product that includes integrated circuit chips, ranging from toys and other low-end applications to advanced computer products having a display, a keyboard or other input device, and a central processor.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A printer system for mounting on a rail, comprising:

a printer having a printhead operatively installed therein, the printer including a housing having opposing thumb screws extending outwardly therefrom; and a mount comprising:

a printer bracket having opposite printer bracket side members each terminating in a distally extending printer bracket side member leg configured for attachment to the rail, the printer bracket side members each further having a mounting slot formed therein with a vertical slot portion and at least one horizontal slot portion; and a rail bracket having a rail bracket top member with opposite substantially downwardly extending rail bracket side members terminating in outwardly extending rail bracket side member legs configured for attachment to the rail;

whereby the printer is received within the mount and selectively positioned therein as by engaging the thumb screws within the mounting slots so as to position the printhead as desired beneath the rail bracket top member.

2. The printer system of claim 1, wherein a printer bracket bottom member spans the printer bracket side members substantially opposite the printer bracket side member legs.

3. The printer system of claim 2, wherein the printer bracket bottom member is substantially perpendicular to the printer bracket side members.

4. The printer system of claim 2, wherein the printer bracket bottom member is substantially below and parallel to the rail.

5. The printer system of claim 1, wherein the printer bracket side member legs are substantially perpendicular to the rail.

6. The printer system of claim 1, wherein each of the printer bracket side member legs terminates in a side member foot for attaching to the rail.

7. The printer system of claim 6, wherein each side member foot is substantially parallel to the rail.

8. The printer system of claim 1, wherein the mounting slot comprises two horizontal slot portions each intersecting the vertical slot portion.

9. The printer system of claim 1, wherein the rail bracket top member is substantially elevated above and parallel to the rail.

10. The printer system of claim 1, wherein each of the rail bracket side members terminates in an outwardly extending rail bracket side member leg for attaching to the rail.

11. The printer system of claim 10, wherein the rail bracket side member legs are substantially perpendicular to the rail bracket side members.

12. The printer system of claim 10, wherein the rail bracket side member legs are substantially parallel to the rail.

13. The printer system of claim 1, wherein the printer further comprises a carriage system having a base operable on a track, the printhead being installed on the base so as to enable lateral movement of the printhead within the printer along and substantially parallel to the rail.

14. The printer system of claim 1, wherein a combination solvent-based and water-based ink is employed in the printhead so as to print on a variety of egg carton substrates selected from the group consisting of cardboard, pulp, foam, and PET.

* * * * *